US005295501A

United States Patent [19]

Vigne

[11] Patent Number: 5,295,501

[45] Date of Patent: Mar. 22, 1994

[54] CIRCUS TENT

[76] Inventor: Jean-Leonard Vigne, 14 route de Lyon, 01360 Balan, France

[21] Appl. No.: 930,798

[22] Filed: Aug. 17, 1992

[30] Foreign Application Priority Data

Aug. 20, 1991 [FR] France ..... 9110613

[51] Int. Cl.[5] ..... E04H 15/00; E04H 15/06

[52] U.S. Cl. ..... 135/99; 135/113; 135/905; 135/908; 52/66; 52/745.17

[58] Field of Search ..... 135/87, 88, 99, 113, 135/905, 908; 52/745.17, 745.18, 66, 222

[56] References Cited

U.S. PATENT DOCUMENTS

| | | | |
|---|---|---|---|
| 748,974 | 1/1904 | McGrath | 135/87 |
| 4,000,750 | 1/1977 | Becher | 135/16 |
| 4,537,210 | 8/1985 | Montgomery | 135/87 |
| 4,690,161 | 9/1987 | Dalo et al. | 135/99 |
| 5,036,874 | 8/1991 | Lynch | 135/905 X |
| 5,103,600 | 4/1992 | Geiger et al. | 52/66 |

FOREIGN PATENT DOCUMENTS

| | | |
|---|---|---|
| 0947585 | 7/1949 | France . |
| 2480826 | 10/1981 | France . |
| 2566449 | 12/1985 | France . |
| 0588208 | 5/1947 | United Kingdom . |

*Primary Examiner*—Carl D. Friedman
*Assistant Examiner*—Robert Canfield
*Attorney, Agent, or Firm*—Oliff & Berridge

[57] ABSTRACT

A tent including a fabric which contains firstly a substantially non-stretching peripheral cable and secondly substantially non-stretching cables, each substantially non-stretching cable extending from a pole to the vicinity of a perimeter edge of the fabric such as a corner. The tent further includes a support provided at each corner, at a height at least equal to that of the perimetric edge of the fabric when the tent is in a raised position, and a winch for hooking on the end of the cables extending from the pole and for tensioning the cables. The tent, applicable as a circus tent, can be raised and lowered rapidly.

10 Claims, 3 Drawing Sheets

CIRCUS TENT

BACKGROUND OF THE INVENTION

The present invention relates to a circus tent, especially a tent with a large surface area that can vary between several tens and several hundreds of square meters, designed to be lowered and raised frequently, as rapidly as possible.

Tents are very frequently used to shelter events temporarily, namely circuses, shows, sporting events, or events of a private nature, and in general all events that do not justify the erection of a permanent shelter.

A tent comprises a fabric covering the area to be protected, generally suspended by: 1) a main pole, located at the peak or ridge; 2) intermediate supports, constituted by poles, between the ridge and a perimetric edge; and 3) other poles being provided at the perimetric edge, the latter poles being guyed. In general, the fabric does not extend down to the ground, so that a sidewall is provided between the perimetric edge and the ground.

While a tent of this kind is satisfactory because of its toughness, it has the disadvantage of requiring a large amount of material to form the armature supporting the fabric, as well as considerable labor for raising and lowering operations.

In the case of traveling shows, such as sporting events, for example, that move every day, or in the case of traveling shows or circuses, it is very important to be able to raise and lower the tent daily as quickly as possible. This is currently impossible with the techniques in current use.

SUMMARY OF THE INVENTION

A goal of the invention is to provide a circus tent of simple design which can cover a large area if required, and which can be raised and lowered very rapidly by a small number of roustabouts.

To this end, the tent in question is of the type comprising a flexible fabric designed to cover the area to be protected, mounted on at least one central pole. The fabric comprises a substantially non-stretching peripheral cable and substantially non-stretching cables, each extending from the pole to the vicinity of a perimeter edge, such as a corner, of the fabric. One support is provided at each corner, at a height at least equal to that of the perimetric edge of the fabric when the tent is in the raised position. The tent is equipped with winches to hook on the end of the cables extending up to the pole and for tensioning the cable.

The fabric of which the tent is made is therefore suspended at the level of the pole by a peak of the tent being slidably mounted on this pole, then tensioned by the winches mounted on supports located primarily, at the corners of the tent. The combination of substantially non-stretching elements, such as cables, inside the fabric, and at the level of the periphery of the latter, provide an excellent support without having to resort to numerous intermediate and peripheral support poles.

BRIEF DESCRIPTION OF THE DRAWINGS

In any event, the invention will be better understood from the following description with reference to the attached schematic diagrams showing, as a nonlimiting example, one embodiment of this tent.

DETAILED DESCRIPTION OF PREFERRED EMBODIMENTS

Figure 1:
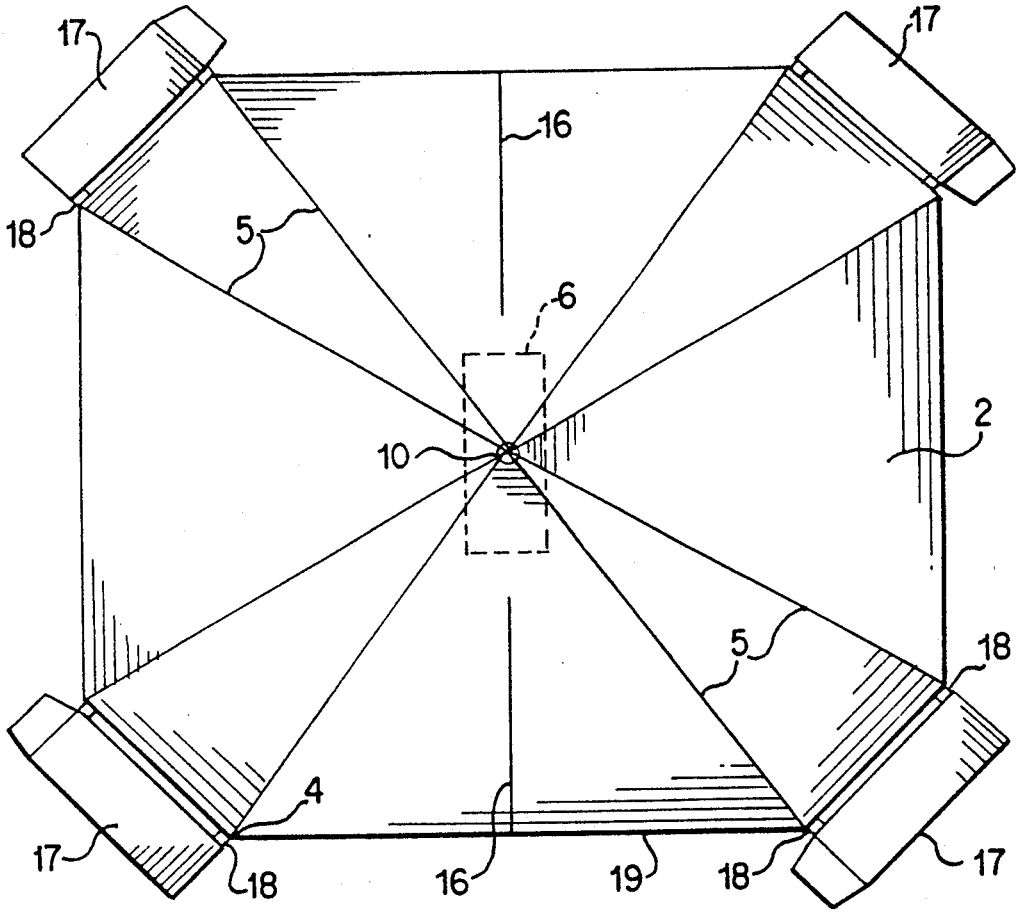
FIG. 1 is a top view of a tent with a generally square shape.
Figure 2:
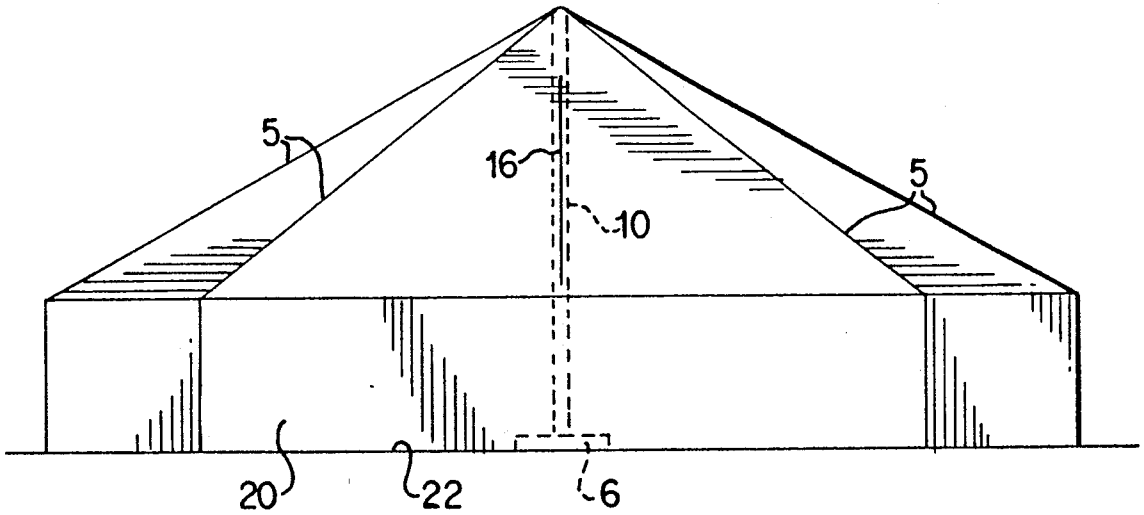
FIG. 2 is a side view of the tent of FIG. 1 in the raised position.

The tent shown in the drawings comprises a fabric of a generally square shape designated by reference numeral 2, each of whose sides is about 30 meters long. The four corners of the square form cut sides. Between the central part of the fabric attached to a peak of the tent 3, and each corner 4 corresponding to one end of a cut side, a substantially non-stretching cable 5 is attached to the inside of the fabric, for example in a hem. In the embodiment shown in the drawings, there are therefore eight cables extending between the center of the tent or its peak 3, and its perimetric edge.

As shown in the drawings, inside the tent and at its center there is a platform 6 on the ground, designed for example to be loaded on the chassis of a truck. This platform 6 can be stabilized with jacks 7. On this platform 6 there is pivotably mounted around a horizontal axis 8 and between two cheeks 9 a lower section 10 of the pole. In a transport position, this section is horizontal and locked by a pin inside a receiving element or bolt 12. The movement from the horizontal position to the vertical position of the section of pole 10 is performed by means of a jack 13 whose body is articulated to platform 6. Jack 13 has a shaft which is articulated inside a cover 14 integral with the pole. The pole can consist, for example, of three sections, of which only a lowest section has been shown in the drawings, with the other two sections being assembled, the second being coupled to the lower section and the third being coupled to the second section likewise. A winch 15 is provided on the platform and is designed to ensure, with the aid of a cable not shown in the drawing, displacement of the peak of the tent 3 along pole 10.

As shown in FIG. 1, the fabric comprises in the axis of platform 6 and on both sides of the latter, two slits 16 extending to the edge of the fabric. With the tent in the raised position, these two slits 16 are closed by lacing or the like. The raising of the tent likewise requires the use of four vehicles 17, each located at one corner 4 of the fabric, and each comprising two winches 18 mounted at a height greater than the height of the perimetric edge of the fabric when the tent is in the raised position. Each cable 5 is attached to one of winches 18. A non-stretching peripheral cable 19 runs around the tent.

In practice, the fabric is initially unfolded starting at platform 6 and then, when the pole has been raised, slits 16 are closed and the peak of the tent 3 is raised halfway. Using winches 18, cables 5 are likewise installed and tensioned halfway up, after which the peak of the tent 3 is raised in a coordinated fashion along with the outer ends of cables 5, thus automatically ensuring tensioning of the fabric, without having to resort to additional tensioning means, or to intermediate or peripheral poles. Then, sidewalls 20 are installed, each of which is attached at an upper edge to cable 19 if it is accessible through holes, or on a cable which is itself attached to cable 19. At a lower end, each sidewall has a strap 22, one end of which is designed to be attached to one of vehicles 17 and the other end designed to be attached to another vehicle 17, and is equipped with tensioning means, for example a pawl-and-ratchet system.

Figure 3:
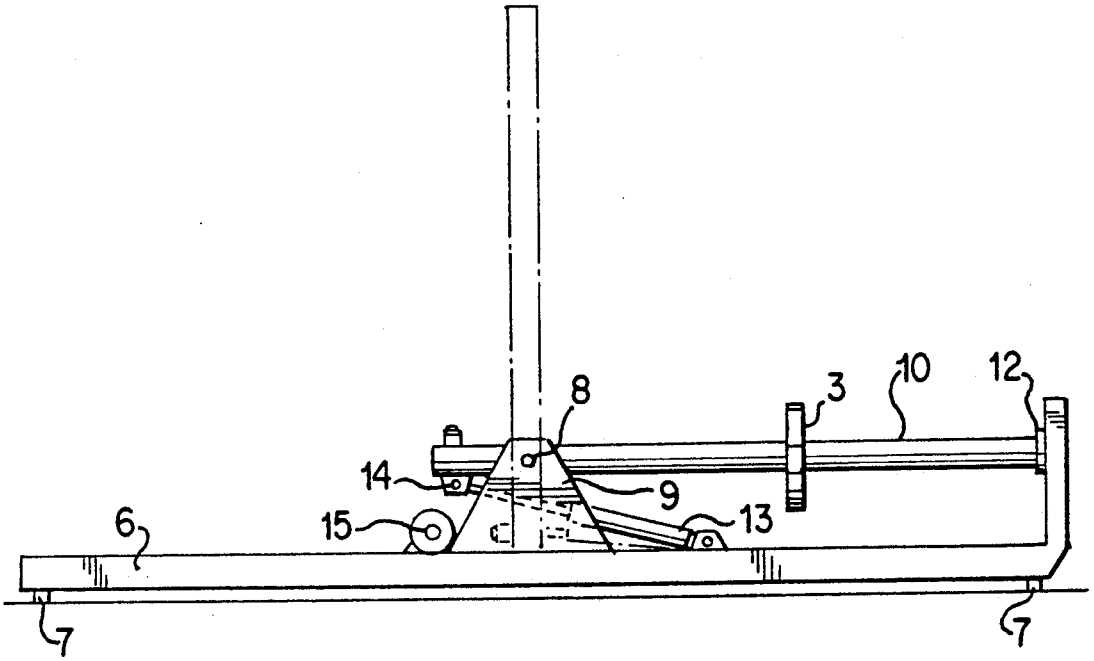
FIGS. 3 and 4 are two enlarged views showing, respectively, the side and front of a platform supporting the lower part of a pole shown in FIG. 2.
Figure 4:
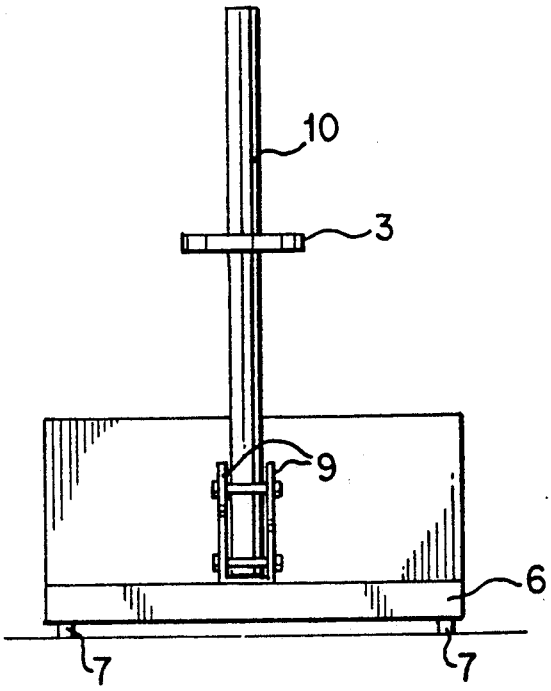

To lower the tent, cables 5 are relaxed by operating winches 18 and the peak of the tent 3 is lowered halfway. In this position slits 16 are opened by unlacing their edges, permitting the areas of fabric located on either side of these two slits to move back toward the outside. The fabric is then lowered completely, whereupon the two areas of fabric located on either side of platform 6 are rolled up toward the latter, thus forming two rolls which extend beyond the front and rear of the platform. The front and rear parts of each roll are then folded onto the platform on either side of the pole, which in turn has been returned to the horizontal position shown in FIG. 3.

Thus, according to one embodiment of this tent, the fabric has, as seen from above, a square or rectangular shape whose corners 4 are truncated, each truncated corner 4 forming one side of a triangle whose other two sides are delimited by two cables 5 extending to a pole.

Advantageously, the winches 18 designed for hooking on and tensioning the cables are mounted on vehicles 17 and each main pole 10 is mounted so that it is articulated around a horizontal axis on a platform 6 designed to form, for example, the trailer of a highway vehicle.

This solution is especially advantageous because it minimizes the equipment required to raise the tent. It is sufficient to unload from a first vehicle the platform bearing the pole, and to position, for example at the four corners of the tent, at predetermined locations, four vehicles bearing the winches that will serve to hold and tension the cables holding the fabric. Each of the four vehicles can hold two winches for example, if the tent is square or rectangular in shape, with the four corners having cut sides.

To facilitate raising and lowering the tent, the platform is equipped with a jack 13 articulated around a horizontal axis, the free end of the jack being articulated on the pole 10, and the platform 6 being equipped with a winch 15 designed to move the peak of the tent, constituted by a ring slidably mounted on the pole.

In addition, the fabric advantageously comprises, in the axis of the platform and on both sides of the latter, two slits 16 extending to the edge of the fabric, which are laced together when the tent is in the operating position.

Before the tent is raised, the slits 16 are laced together. When the tent is lowered, the laces holding the slits 16 closed are withdrawn so that the slits are open. It is possible after the fabric has been rolled up, beginning at its two edges furthest from the platform to the platform, to pull onto the latter, from each side of the pole 10, two rolls of fabric, besides the central part resting directly on the platform.

According to another embodiment of the invention, the perimetric edge of the fabric comprises a cable 19 serving to hold, with the aid of hooks, the sidewalls. The lower edge of each sidewall, located at ground level, is provided with a strap, one end of which is attached to a fixed point and the other end is provided with a device for tensioning the strap relative to the fixed point.

As indicated above, the invention provides a considerable improvement in the existing technology by providing a circus tent of simple design which requires less equipment and which can be raised and lowered very easily. For example, a tent like that shown in the drawing, covering an area of about 900 square meters, can be raised or lowered in less than one hour by a team of six persons.

Of course, the invention is not limited to the single embodiment of this tent described above as a non-limiting example and, on the contrary, includes all variations thereon. For example, the size of the tent could be modified or the tent could include two poles, without thereby departing from the scope of the invention.

What is claimed is:

1. A tent raisable between a lowered position and a raised position comprising:

at least one pole;

a flexible fabric mounted on said at least one pole, said fabric having a perimetric edge that includes a plurality of corners, said fabric further containing substantially non-stretching cables affixed thereto for supporting said fabric, each of said cables extending from said pole to a vicinity of the perimetric edge near one of the plurality of corners of said fabric, said perimetric edge being at a predetermined height when the tent is in the raised position;

a support provided at each of said corners at a height at least equal to the predetermined height of said perimetric edge of said fabric when the tent is in the raised position; and a plurality of winches located at or higher than the predetermined height of the perimetric edge, one winch being associated with each of said corners and each winch being connected to at least one of said cables in the vicinity of one of said corners for tensioning said cables to support and raise said fabric.

2. The tent according to claim 1, wherein said fabric is of a shape chosen from the group consisting of generally square and rectangular perimeters, said shape having truncated corners, each truncated corner forming one side of a triangle whose other two sides are delimited by two of said cables extending from said pole.

3. The tent according to claim 1, wherein said winches are mounted on vehicles.

4. A tent according to claim 1, wherein said at least one pole is pivotally mounted on a platform for movement about a horizontal axis between a horizontal and a vertical position, said platform forming a trailer of a highway vehicle.

5. A tent according to claim 4, wherein said platform includes a jack, an end of said jack being articulated on said at least one pole at a position offset from said axis.

6. A tent according to claim 4, wherein said platform includes a winch that displaces a peak of the tent between the lowered position and the raised position, said peak being constituted by a ring slidably mounted on said at least one pole, said ring supporting a central part of said fabric, said winch being operatively coupled to said slidably mounted ring to provide said displacement.

7. A tent according to claim 4, wherein said platform has a longitudinal axis and two longitudinal ends and said fabric includes two slits, said slits being located along a vertical plane constituted by said longitudinal axis when said tent is in at least the raised position, one on each longitudinal end of said platform, and extending from a point horizontally displaced from a periphery of said platform to the perimetric edge of said fabric, said slits being closed by a closing means when said tent is in said raised position.

8. The tent according to claim 1, wherein a cable extends around said perimetric edge of said fabric.

9. The tent according to claim 8, wherein said cable around said perimetric edge of said fabric includes attachment means for retaining sidewalls.

10. The tent according to claim 9, wherein said sidewalls are tensioned relative to a fixed point located near ground level by a tensioning device.

* * * * *